United States Patent [19]

McCracken et al.

[11] 4,310,197

[45] Jan. 12, 1982

[54] MINING AND BOLTING METHOD AND APPARATUS

[75] Inventors: William E. McCracken, Pittsburgh, Pa.; Gary A. Hakes, Hopewell, N.J.

[73] Assignee: Lee-Norse Company, Pittsburgh, Pa.

[21] Appl. No.: 145,686

[22] Filed: May 1, 1980

[51] Int. Cl.[3] ..... E21D 17/10; E21D 21/00

[52] U.S. Cl. ..... 299/11; 299/33; 405/290

[58] Field of Search ..... 299/11, 31, 33; 405/290

[56] References Cited

U.S. PATENT DOCUMENTS 2,772,871 12/1956 Caine ..... 299/64 X 3,995,905 12/1976 Jamison ..... 299/33 X

FOREIGN PATENT DOCUMENTS 1250928 12/1960 France ..... 405/290

*Primary Examiner*—Ernest R. Purser

*Attorney, Agent, or Firm*—Joseph T. Harcarik

[57] ABSTRACT

A mining method and bolting apparatus. Material is dislodged from a mine face by means of a miner wherein the face is advanced. The dislodged material is transported from the mine face for further handling. A temporary roof support of cross beams supported by beam jacks is provided. A bolting apparatus installs bolts in the mine roof providing a permanent roof support. Cross beams and beam jacks are lowered, manually moved forward and reinstalled wherein the temporary mine roof support is advanced. The mining apparatus and bolter is advanced under the advanced temporary roof support to the advanced mine face.

16 Claims, 4 Drawing Figures

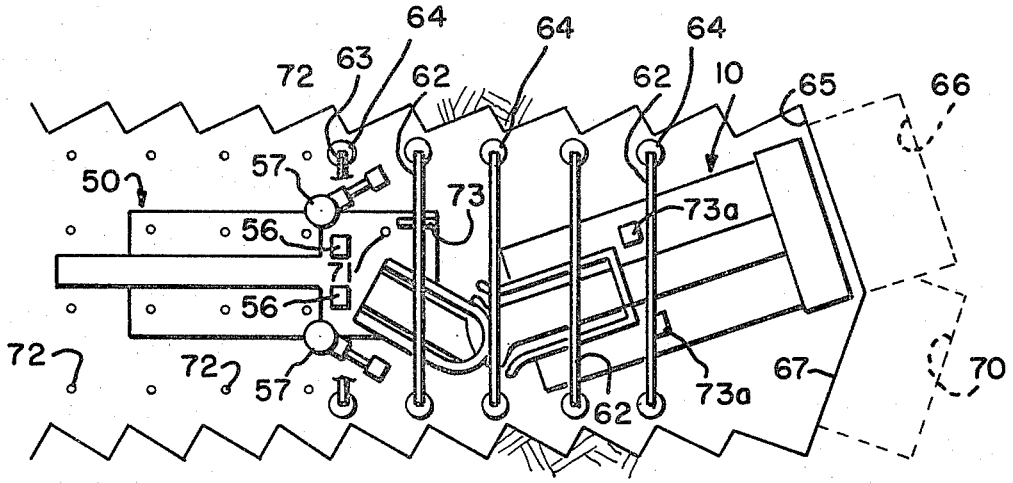
FIG. 1
FIG. 2
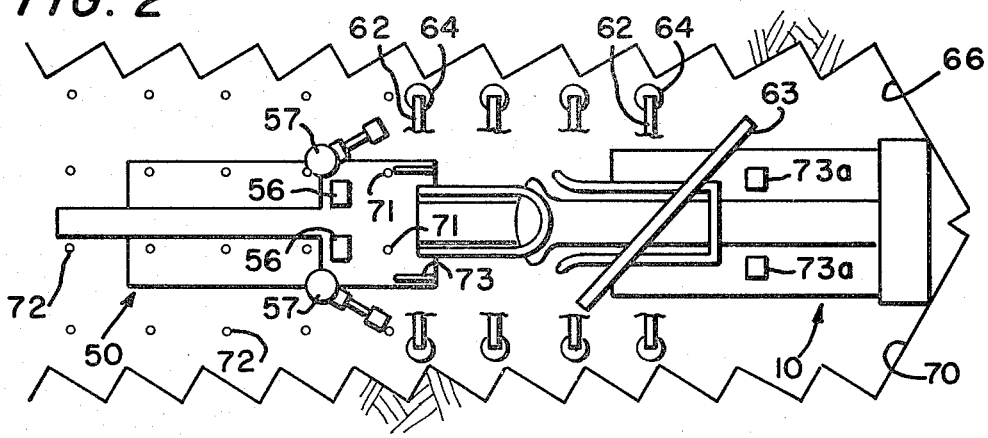
FIG. 3
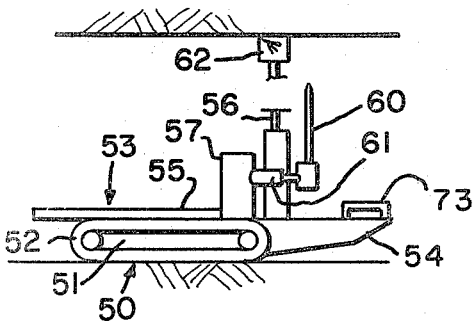
FIG. 4
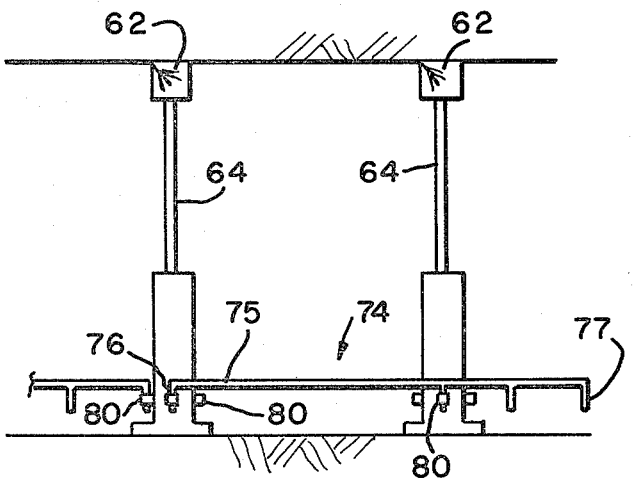

MINING AND BOLTING METHOD AND APPARATUS

This Application is related to co-pending Application "A Mining Apparatus and Method", Ser. No. 145,847, by Gary Arthur Hakes and William Edward McCracken which Application is filed concurrently with this Application and is herein incorporated by reference.

BACKGROUND OF THE INVENTION

1. Field of the Invention

This invention pertains to a method and apparatus for mining and more particularly to a method for dislodging material from a mine face under an advancing temporary mine support.

2. Description of the Prior Art

In the past the material has been removed from a mine by placing a mining apparatus in the vicinity of the mine face and removing material from the mine face to a depth of approximately ten to twenty feet. The miner is then removed from the mine face and a roof support system is installed in the excavated portion of the mine. After a roof support system has been installed, the miner is then brought back to the mine face and the mining operation continued. The removing and bring back of the miner to the mine face is a cumbersome and time consuming operation often causing damage to the equipment. A more efficient mining operation has been sought.

In U.S. Pat. No. 3,995,905, an apparatus is disclosed which attempts to avoid this problem. A series of roof beam supports are hydraulically raised from a mining apparatus which temporarily supports the roof as material is dislodged from the mine face. Roof bolts are installed at the rear section of the temporary roof supports. When the miner is to be advanced, the series of temporary roof supports are lowered and the miner is advanced. After the miner has advanced, the series of temporary roof supports are lifted and resupport the roof. The roof of the mine, however, is subjected to the cycle of support, nonsupport and resupport. This cycling of the mine roof is detrimental to the structure of the mine roof causing weakness of the roof.

The apparatus, furthermore, requires an extensive amount of hydraulic lifting equipment making the apparatus cumbersome, difficult to maneauver and prone to mechanical failure.

More recently in U.S. Pat. No. 4,143,991 an apparatus is described for providing a temporary support system over the miner which is not attached to the miner. This Patent, however, as with the above mentioned U.S. Pat. No. 3,995,905, is also cumbersome and has the undesirable affect of cycling the roof.

A simplified means for providing a temporary roof support system which does not cycle the roof has been sought.

SUMMARY OF THE INVENTION

This invention relates to a mining method wherein a mining apparatus and a bolting apparatus in a mine entry is positioned near a mine face under a temporary roof support. The temporary roof support is comprised of cross beams supported by beam jacks. The mining apparatus removes material from the mine face advancing the mine face. The dislodged material is removed from the mine face. Above the bolting apparatus roof bolts are installed providing a permanent roof support. By a lowering means on the bolting apparatus, cross beams of the temporary roof support which support portions of the roof now supported by permanent roof bolts are lowered. The lowered cross beams and accompanying beam jacks are manually transported to a lifting mechanism on the mining apparatus and lifted into a support of the roof.

According to the present invention, as the mining and bolting apparatus advances, the cross beams installed remain in position until a permanent roof support is installed. Then a cross beam from the rear is brought forward and raised into place at the front, rather than moving a series of beams forward in tandum. Cycling of the roof is thus eliminated.

Furthermore, since each beam is individually installed, the machine has great flexability which enables it to maneauver corners easily. In addition, only one set of mechanical lowering and lifting mechanism is involved. insuring more reliability.

BRIEF DESCRIPTION OF THE DRAWINGS

FIG. 1 is a schematic top view illustration of the bolting apparatus and the mining apparatus in a mine entry showing temporary cross beam supports which have been installed.

FIG. 2 is a schematic top view illustration of the bolting apparatus and the mining apparatus in a mine entry showing a cross beam being moved forward.

FIG. 3 is a schematic side view illustration of the bolting apparatus.

FIG. 4 is a schematic side view illustration of beam jacks connected with cross supports.

DESCRIPTION OF THE PREFERRED EMBODIMENT

Referring to FIGS. 1 and 2, there is shown in a mine entry a mining apparatus generally designated as 10 and a bolting apparatus generally designated as 50. Mining apparatus 10 is described in more detail in the above mentioned co-pending Application entitled "A Mining Apparatus and Method" by Gary Arthur Hakes and William Edward McCracken filed concurrently with this Application and incorporated by reference.

As shown in FIG. 3, bolting apparatus 50 comprises a body 51. Body 51 has a forward section facing mining apparatus 10 and a rear section positioned away from mining apparatus 10. A ground engaging means 52 is provided for maneauvering bolting apparatus 50 through the mine. Ground engaging 52 includes conventional means such as rubberized wheels, metal wheels, rails and caterpillar moving mechanisms. A conveying means 53 is provided to convey dislodged material received from mining apparatus 10 in the forward section of bolting apparatus 50 to the rear section of bolting apparatus 50. Conveying means 53 includes conventional means such as belt and bucket conveyors. In FIG. 3 conveying means 53 is shown as a receiver hopper 54 which receives dislodged material from mining apparatus 10 and conveyor belt 55 which transports the received dislodged material rearward for further handling. A lowering means 56 is provided on body 50 for lowering cross beams 62 and 63 from the mine roof. Lowering means 56 includes conventional lowering means such as hydraulic, mechanical and jacking lowering devices. Cross beams 62 and 63 include conventional types such as wood, metal and plastic. A bolting means 57 is provided on body 51 for installing roof bolts 60 into the mine roof. Installing roof bolts is well known to the art. First a hole is drilled into the roof by conventional means and then bolt 60 is inserted into place. As shown in FIG. 3, bolting means 57 is pivotally mounted to body 51 and comprises an extension arm 61. This enables roof bolts to be installed at various places in the roof while bolting apparatus 50 remains stationary.

Referring to FIG. 1, mining apparatus 10 and bolting apparatus 50 are under a series of cross beams 62 and a cross beam 63. Cross beams 62 and cross beam 63 are supported by beam jacks 64 as shown in FIG. 4. In FIG. 1, mining apparatus 10 is positioned in front of mine face 65. Mining apparatus 10 dislodges material from mine face 65 and advances to mine face 66. Mining apparatus 10 is withdrawn to the position shown in FIG. 1 and then is turned to face 67 and advanced to mine face 70.

As mining apparatus 10 is dislodging material from the mine faces, bolting means 57 is installing roof bolts 71 above bolting apparatus 50. Roof bolts 72 have been installed previously to the rear of cross beam 63. After roof bolts 71 have been installed, mining apparatus 10 is positioned as shown in FIG. 2. Cross beam 63 is lowered from the roof by lowering means 56. Cross beam 63 is then manually transported forward to lifting means 73*a*. Cross beam 63 may either be brought forward with beam jacks attached to the cross beams or the beam jacks may be removed from the cross beams and each brought forward separately. A wheeled or sled device may also be employed to manually move cross beam 63 forward.

As cross beam 63 is brought forward, a support means on mining apparatus 10 may be provided. The support means on bolting apparatus 50 includes conventional supports such as a rail or a set of rails 73 including rails made of conventional material such as metal, wood and plastic.

After the cross beam 63 is transported to lifting means 73*a*, cross beam 63 is lifted to the mine roof to provide support with beam jacks supporting the cross beam 63.

Bolting apparatus 50 is then advanced towards mining apparatus 10 and mining apparatus 10 is positioned in front of mine face 66 and the process is repeated.

In another embodiment of this invention, as shown in FIG. 4, beam jacks 64 are interconnected with staples 74. Staples 74 provide additional stability to beam jacks 64 rendering them less vulnerable to being accidentally dislodged. Staples 74 may be comprised of a bar 75 having a prong 76 at one end and teeth 77 at the other end. Bar 75 may be a conventional bar which includes solid bars and tubing. Bar 75 may be constructed of conventional material which includes metal, wood and plastic. Staples 74 are removably connected to beam jacks 64 at sockets 80. In order to connect staple 74 with beam jacks 64, prong 76 is inserted into sockets 80 of a beam jack 64. The other beam jack 64 before it is loaded is rotated so that a tooth 77 will insert into a socket 80. Beam jack 64 is adjusted to provide support to the mine roof.

We claim:

1. A method of mining, wherein a mining apparatus and a bolting apparatus in a mine entry is positioned near a mine face and under a temporary roof support comprised of cross beams supported by beam jacks, that comprises:

a. dislodging material from the mine face with a mining apparatus wherein the mine face is advanced;
b. transporting dislodged material from the mine face;
c. installing roof bolts above the bolting apparatus to provide permanent roof support;
d. removing a cross beam support with a lowering means on the bolting apparatus;
e. transporting the cross beam by manual means to a lifting means on the mining apparatus;
f. lifting the cross beam to the mine roof with the lifting means;
g. supporting the cross beam with beam jacks wherein the lifting means is lowered and the temporary roof support is advanced;
h. advancing the mining apparatus and the bolting apparatus towards the advanced mine face; and
i. repeating steps a, b, c, d, e, f, g and h.

2. A method of mining according to claim 1, wherein the material is dislodged from the mine face by a pick studded rotary drum.

3. A method of mining according to claim 1, wherein the dislodged material is transported from the mine face by a gathering head and a conveyor belt on the mining apparatus and a receiving hopper and a conveyor belt on the bolting apparatus.

4. A method of mining according to claim 1, wherein roof bolts are installed by a bolting means that is pivotally mounted to the bolting apparatus and that comprises an extension arm.

5. A method of mining according to claim 1, wherein the lowering means is a hydraulic lowering mechanism.

6. A method of mining according to claim 1, wherein the lifting means is a hydraulic lifting mechanism.

7. A method of mining according to claim 1, wherein the bolting apparatus is advanced by a caterpillar moving mechanism.

8. A method of mining according to claim 1, further comprising interconnecting the beam jacks with removable staples.

9. A method of mining according to claim 9, wherein the staples comprise a bar having a prong at one end and teeth at the other end.

10. A bolting apparatus which comprises:

a. a body having a forward section and a rear section;
b. a ground engaging means for enabling movement of the body through a mine;
c. a conveying means for transporting dislodged material from the forward section to the rear section;
d. a bolting means for installing roof bolts in the mine roof;
e. a lowering means for lowering cross beams from the roof of a mine wherein beam jacks are permitted to engage the cross beams to provide support to the mine roof.

11. A bolting apparatus according to claim 10, wherein the ground engaging means is a caterpiller moving mechanism.

12. A bolting apparatus according to claim 10, wherein the conveying means comprises a receiving hopper and a conveyor belt.

13. A bolting apparatus according to claim 10, wherein the bolting means is pivotally mounted to the bolting apparatus and comprises an extension arm.

14. A bolting apparatus according to claim 10, wherein the lowering means is a hydraulic lowering mechanism.

15. A bolting apparatus according to claim 10, further comprising a cross beam supporting means for enabling movement by manual labor of cross beams from the rear section to the forward section.

16. A bolting apparatus according to claim 15, wherein the cross beam supporting means is a rail.

* * * * *